US006173002B1

(12) United States Patent
Robert

(10) Patent No.: US 6,173,002 B1
(45) Date of Patent: Jan. 9, 2001

(54) ELECTRIC ARC GASIFIER AS A WASTE PROCESSOR

(76) Inventor: Edgar J. Robert, 632 Northaven Cir., Glenshaw, PA (US) 15116

( * ) Notice: Under 35 U.S.C. 154(b), the term of this patent shall be extended for 0 days.

(21) Appl. No.: 09/551,031

(22) Filed: Apr. 17, 2000

Related U.S. Application Data

(60) Provisional application No. 60/130,350, filed on Apr. 21, 1999.

(51) Int. Cl.[7] ..... F27D 17/00

(52) U.S. Cl. ..... 373/9; 373/8; 373/18

(58) Field of Search ..... 373/1, 2, 8, 9, 373/18, 60, 61, 62, 63, 68; 219/121.11, 121.36, 121.37; 110/346, 250, 235, 243; 75/10.35, 10.36, 10.61, 10.66; 48/103

(56) References Cited

U.S. PATENT DOCUMENTS

| | | | | |
|---|---|---|---|---|
| 3,575,119 | | 4/1971 | Marr, Jr. . | |
| 4,181,504 | * | 1/1980 | Camacho | 373/8 |
| 4,760,585 | | 7/1988 | Queiser et al. . | |
| 4,995,324 | | 2/1991 | Williams . | |
| 5,090,340 | | 2/1992 | Burgess . | |
| 5,259,863 | * | 11/1993 | Schneider et al. | 75/414 |
| 5,493,580 | * | 2/1996 | Fudala | 75/10.61 |
| 5,566,625 | | 10/1996 | Young . | |
| 5,666,891 | | 9/1997 | Titus et al. . | |
| 5,748,666 | * | 5/1998 | Andersson et al. | 373/9 |
| 5,798,497 | | 8/1998 | Titus et al. . | |
| 5,811,752 | | 9/1998 | Titus et al. . | |
| 6,061,383 | * | 5/2000 | Katayama | 373/8 |

* cited by examiner

*Primary Examiner*—Tu Ba Hoang
(74) *Attorney, Agent, or Firm*—Law Offices of K. Patrick McKay, PE, Esq.

(57) ABSTRACT

An electric arc gasifier adapts to the variable chemical components of waste products by utilizing mobile and fixed electrodes and a positioning system wherein a waste is injected into a heating chamber and broken down into elemental components capable of being recycled. A primary injection is heated by an electric arc formed between two electrodes. A secondary fluid consisting of the waste and a carrier gas is then injected and mixed with the heated primary fluid. A reaction zone within the fixed electrode of the heating chamber accelerates a resulting mixture of gases, solids, and liquids into a mixing chamber, wherein the resulting high-temperature, high pressure mixture may be combined with a tertiary spray. An efficient destructive rate stemming from the high temperature plasma formed by the electric arc allows for low cost waste processing and a means for recovering high value metals.

20 Claims, 7 Drawing Sheets

ELECTRIC ARC GASIFIER AS A WASTE PROCESSOR

This application claims the benefit of U.S. Provisional No. 60/130,350 filed Apr. 21, 1999.

BACKGROUND OF THE INVENTION

1. Field of the Invention

The present invention relates to a method of using an electric arc gasifier to process waste. A plasmatic primary fluid heated by an electric arc mixes with injected waste to crack and gasify the components of the mixture. The instant method provides a high waste destructive rate with a low cost process, which can be aimed to produce chemical or gaseous products and recover high value metals.

2. Description of the Related Art

There are a number of methods developed to process waste in various forms, and with a variable degree of efficiency as the economics of most processes do not account for a high degree of destruction of the waste, i.e. low cost processes creates a liability from an environmental point of view. On the other hand, processes that do have high destruction rates also have very expensive operating costs. Our invention overcomes these problems to combine low operating and capital costs with high destruction efficiency.

Common methods include the use of electrodes to implement the use of high temperatures in a furnace for destroying waste (Queiser et al). Also, known in the art are methods and apparatuses for disintegrating or incinerating waste using arc-forming electrodes. Electric arcs abruptly raise temperatures of compounds from the heat of alternative fluids to form a high temperature plasma. In particular, as can be seen in U.S. Pat. No. 5,811,752 by Titus et al., a molten pool provides a conducting path for at least two arc forming electrodes capable of providing and maintaining joule heating to convert waste dissolved in a liquid pool to stable products. Operating conditions of this process are dependent, however, on the desired liquid pool medium used for chemical modification of the waste. Gaseous or liquid compounds, and even solids with high volatile content may bypass the destruction medium as they fall into the port of melted down ceramic metal, thereby producing secondary waste.

As can be demonstrated by U.S. patent application Ser. No. 09/152,636, an electric arc-activated, non-catalytic burner can produce synthetic gas by mixing an injection with an ignited primary fluid under high temperature and high pressure to produce gases used for combustion or other industrial processes. A new method of use can be demonstrated to account for waste processing of products that have variable chemistry.

As an example, electric arc furnaces are used for the production of steel, and the material charged to these furnaces is usually steel scrap and eventually direct reduced iron. The production of steel by this method generates a significant amount of dust that is collected in a baghouse or similar equipment in the fumes purification system. The disposal of EAF dust is costly because of the presence of heavy metals in its chemistry. The present method is particularly suitable for the treatment and recycling of the components of this dust, as well as other costly and inefficiently recoverable wastes, such as chlorinated hydrocarbons.

Chlorinated hydrocarbons are a waste produced by some chemical processes. The disposal of this waste is costly and the recovery is inefficient. The electric arc gasifier can process these chlorinated hydrocarbons, recover hydrochloric acid, and produce synthetic gas (CO, $H_2$, or carbon dust and $H_2$) in a very efficient manner.

The bulk of chlorinated hydrocarbons is processed in incinerators (rotary kilns). The thermal efficiency of the incinerators is low. The capital cost is in the same order of the electric arc gasifier process or higher, but the operating cost is higher due to low efficiency and consumable cost. In addition, environmental permitting is difficult because of formation of dioxins and NOx. The emissions also increase the liability associated to the operation of the plant.

There is a need, then, for a more efficient method of processing waste using the electric arc method that will automatically correct operating conditions based on the complexity of waste products and variably be capable of recycling desired compounds.

PRIOR ART

U.S. Pat. No. 3,575,119, Apr. 13, 1971 (Marr, Jr.) teaches an electrical arc apparatus for disintegrating and incinerating a slurry organic material. The bonds between carbon and other atoms are dissolved as solid organic matter is continuously positioned between two arc forming electrodes.

U.S. Pat. No. 5,811,752, Sep. 22, 1998 (Titus et al.) shows a tunable waste conversion systems and apparatus. The methods and apparatus for such conversion include the use of a molten oxide pool having predetermined electrical, thermal and physical characteristics capable of maintaining optimal joule heating and glass forming properties during the conversion process.

U.S. Pat. No. 4,760,585, Jul. 26, 1988 (Queiser et al.) teaches how radioactive wastes are treated in a furnace which has electrodes for electric heating. Carbon-containing waste, possibly also carbon of a carbon bed, is reacted to form water gas ($CO+H_2$), which is burned after purification in an exhaust gas plant.

U.S. Pat. No. 4,995,324, Feb. 26, 1991 (Williams) demonstrates a system for recovery of the heat value of waste material. Collected bales of waste material are passed through a bale breaker to release the waste material into a free condition so it can move in a free flowing stream into a conveyor-type storage unit for movement to a grinder.

U.S. Pat. No. 5,090,340, Feb. 25, 1992 (Burgess) shows an apparatus and method for the disintegration of waste by subjecting the waste within a closed chamber to plumes of an electrically generated high temperature plasma. One embodiment comprises a portable device capable of disintegrating waste over a large area such as at a waste dumpsite.

U.S. Pat. No. 5,566,625, Oct. 22, 1996 (Young) teaches a high temperature combustion apparatus incorporating a pneumatically suspended combustion zone and capable of supporting relatively high combustion temperatures in excess of 2400° C. (4352° F.).

U.S. Pat. No. 5,666,891, Sep. 16, 1997 (Titus et al.) demonstrates a relatively compact and highly robust waste-to-energy conversion system and apparatus. In one embodiment of the invention, the conversion system includes an arc plasma furnace directly coupled to a joule heated melter.

U.S. Pat. No. 5,798,497, Aug. 25, 1998 (Titus et al.) shows a relatively compact self-powered, tunable waste conversion system and apparatus. The preferred configuration of this embodiment of the invention utilizes two arc plasma electrodes with an elongated chamber for the molten pool such that the molten pool is capable of providing conducting paths between electrodes.

SUMMARY OF THE INVENTION

It is the objective of the present invention to process and destroy waste in powder, liquid, slurry, or gaseous form, and to process waste of variable chemistry using an electric arc gasifier that will automatically adapt to the processing of the various compounds, and will automatically correct for various operating conditions.

It is a further objective of the present invention to recombine elements produced in the destruction of the waste into useful products and gases such as HCl and $H_2$, and carbon black for industrial applications.

It is a further objective of the present invention to inject a tertiary fluid to control the metallurgy of the process, and condition slag formers to suit the application, as well as to remove undesirable compounds or elements from the gas stream.

It is a further objective of the present invention to eliminate the possibility of dioxin, furane, and NOx formation during the destruction process.

It is a further objective of the present invention to use the reactor as a low cost, high power plasma torch with power levels up to 150 MW in continuous operation.

DETAILED DESCRIPTION OF THE PREFERRED EMBODIMENT

The method will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated device, and such further applications of the principles of the invention illustrated herein, as would normally occur to persons skilled in the art to which the invention relates.

Figure 1:
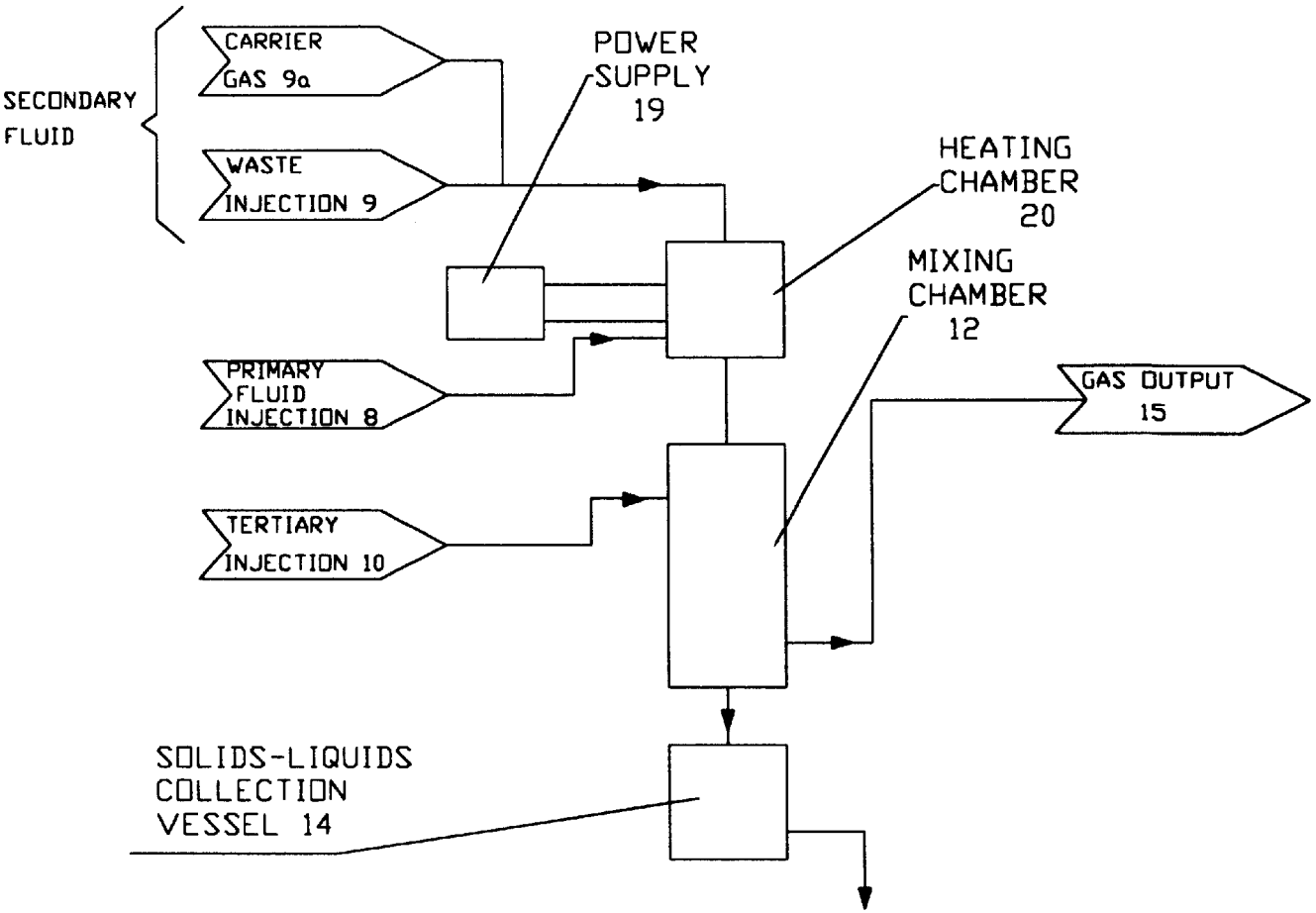
FIG. 1 is a process flow diagram of the method of an electric arc gasifier showing the stages of product chamber mixing and output.

The method of processing waste is shown in FIG. 1. The process entails the injection of a primary fluid 8 that is heated by an electric arc formed between two electrodes, thereby producing a plasma. The position and behavior of this plasma is defined by the flow rate of the primary fluid 8 in response to a system control device, which allows for an adjustment of the electrodes based on the flow rate of the primary fluid 8 and a system operating pressure.

An AC or DC power supply 19 provides the necessary power for the electric arc. A waste as a waste injection 9 will be part of a secondary fluid that will then be injected into an entrance port that leads to a heating chamber 20 as further described. The waste injection 9 in this process may include high value metals bearing spent catalyst from a chemical industry, or waste pickle liquor from Tantalum pickling lines. Tantulum is a metal processed by rolling (or forging). To improve the surface finish of the tantalum sheet, the Tantulum is usually pickled with a liquid containing hydroflouric acid (BY), hydrogen peroxide ($H_2O_2$) and water. As a result of the pickling process the liquid increases the concentration of Tantulum. When the concentration of Tantalum is high (300–350 g/l), the bath is replaced with a new solution. The application of the present method will allow the recovery of HF and metallic tantalum in an efficient manner. The waste injection 9 for all processes described herein may be waste in solid, liquid, gas, or slurry form.

The secondary fluid also includes a carrier gas 99 that is mixed with the waste injection 9 and into the plasma formed from the primary fluid 8. The carrier gas 9*a* can be an inert gas, a hydrocarbon, steam, or $CO_2$.

The primary fluid 8 will develop an extremely high temperature in the electric arc. This temperature may be approximately 5500° C. or higher. At such a temperature, the fluid will crack into the elemental components. The waste injection 9 with carrier gas 9*a* will mix with the heated primary fluid 8, increasing in temperature. The temperature of the mix will depend on the flow rate ratios and physical properties of the fluids. The system will be designed to obtain a temperature of the mixed fluids required by the process. This temperature will be selected based on the properties of the material used as electrodes, and the nature of the waste. Given the high temperature at which these fluids will be exposed, the dissociation of the compounds will occur at a very high reaction rate.

This method will allow the operation of the heating chamber 20 and a mixing chamber 12 at pressures ranging from vacuum, to several hundreds of psi, limited only by the pressure vessel that contains the components. When the pressure is increased, the conductivity of the gas in the electric arc will increase, and the length of the arc will increase accordingly. The internal design of the electrodes allows for an automatic correction of the position of the mobile electrode in relation to the fix electrode based on the electrical response of the electric arc, as will be further described.

A mixture of gases, solids, and liquids are formed as the secondary fluid is mixed into the plasma of the primary fluid 8 at the high temperature. This mixture is passed into the fixed electrode 4 (FIG. 3) of the heating chamber 20, wherein the mixture is accelerated into a mixing chamber 12 by the sudden expansion of the gases of the mixture. The acceleration of the mixture is caused by two effects; a) the cracking of methane with formula CH4(g)=>2H2(g)+C(s) where each mol of methane generates two mols of hydrogen; b) the sudden increase in the temperature of the gas from room temperature to about 1,600° C. increases the actual volume of gas. The combined effect of these two mechanisms increases the velocity of the gas by about 12 times within the fixed electrode 4 (FIG. 3).

After the gas from the mixture accelerates into the mixing chamber 12, a tertiary injection 10 is injected therein at pressures up to 150 psi. The tertiary injection 10 may be a reductant or an oxidant injected to react the carbon dust to CO. The ratio for the oxidant will be set to react as much carbon as required to achieve a preset maximum concentration of $CO_2$. The oxidant could be air, oxygen, steam, $CO_2$ or equivalent. Injecting steam can modify the ratio of CO to Hydrogen. Other substances could be injected with the tertiary injection 10 to condition the solids or liquids formed during the chemical reaction and condensation process. In general, the mixing chamber 12 will operate at a high temperature to obtain the desired reaction rate. The gas produced can be removed from the reactor via a gas output port 15. Any liquid or solid phase formed in the mixing chamber 12 will precipitate and drop out in the solids liquids collection vessel 14, which can be drained. This liquid or solid may be metal contained in the waste, or slag formed during the process, as well as some carbon dust.

Figure 2:
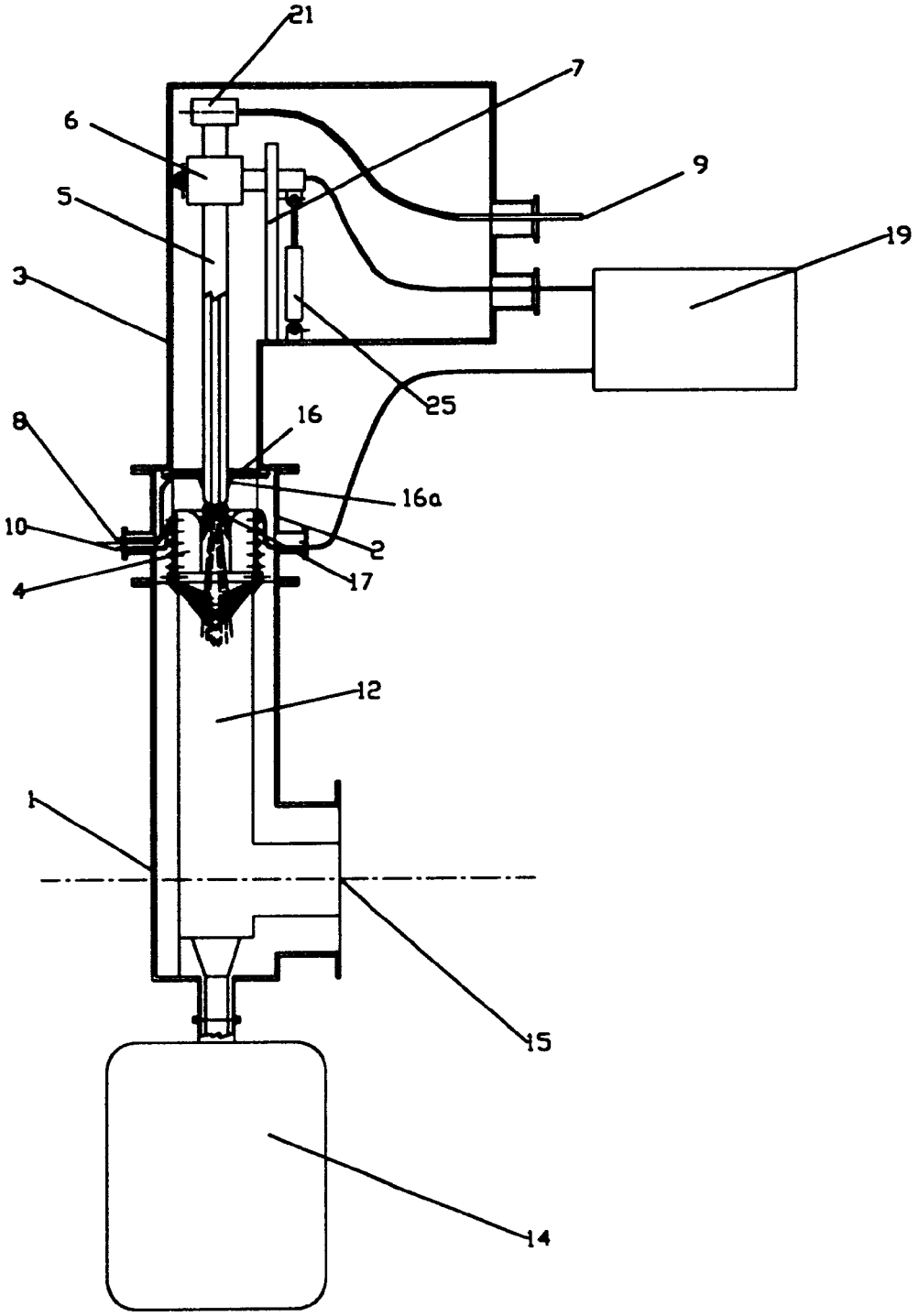
FIG. 2 is a side view of the electric arc gasifier system equipment showing the constituent parts, particularly the four major subassemblies: containment shell lower body, the containment shell intermediate body, with mixing chamber, the containment shell upper body with electrode positioning system, and the power supply.
Figure 3:
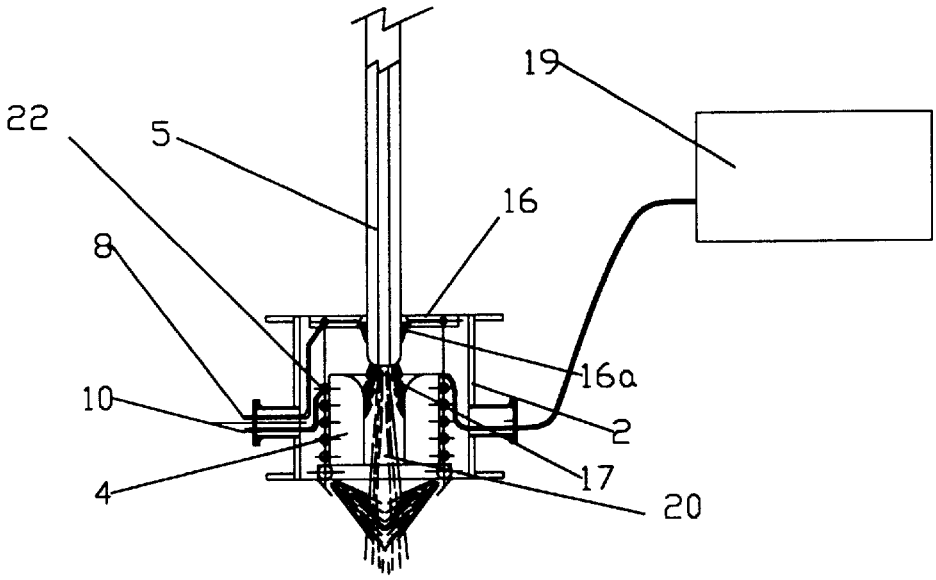
FIG. 3 is a detailed view of the electric arc gasifier system containment shell intermediate body, particularly the electrode and electric arc components.

A typical equipment configuration for the employment of the instant method is shown in FIG. 2 and in more detail in FIG. 3. It consists of a containment shell lower body 1, containment shell intermediate body 2, and containment shell upper body 3 that provides the pressure boundary for the system. Inside the containment shell intermediate body 2, which also forms a pressure containment boundary, there is a heating chamber having a fixed electrode 4, and a mobile hollow electrode 5, both made from graphite or similar material. The electrode guiding system 7 and the electrode positioning system 25 control the position and alignment of the mobile hollow electrode 5. The mobile hollow electrode 5 is secured by an electrode clamp 6. Electric wires connect the mobile hollow electrode 5 and the fixed electrode 4, to the power supply 19. The power supply 19, may be AC or DC. The objective of this power supply 19 is to create an electric arc 17 between both electrodes, and, together with the electrode positioning system 25, to provide stability to the arc in various operating conditions.

Figure 4:
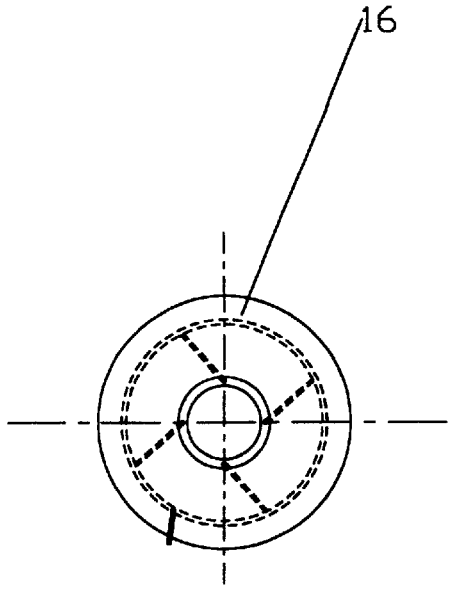
FIG. 4 is a top view of the electric arc gasifier system equipment showing the primary fluid annular distributor.

Several fluids may be injected in the system to produce the desired results. The primary fluid 8, feeds a primary fluid annular distributor 16 (FIG. 4) which creates the primary gas spray 16*a* (FIG. 3). The fluid may be a hydrocarbon, nitrogen, argon or any other fluid that may be selected based on the objective of the application. The objective of this fluid is to create a swirl effect at the tip of the mobile hollow electrode 5 that will impose a rotating movement on the electric arc 17. This rotating movement decreases wear on the electrodes. A further objective of the primary fluid 8 is to flow the fluid through the electric arc 17, and increase its temperature, creating a flame of plasma that will flow through the interior of the fixed electrode 4. A further objective of this primary fluid 8 is to push the electric arc 17 into the fixed electrode 4, thereby increasing the contact between the electric arc 17 and the secondary fluid.

The mixing chamber 12 provides enough residence time to assure a complete mixing and reaction of the substances, thereby insuring a complete chemical reaction. Typically, this chamber is sized to provide at least 0.2 seconds of residence time. The temperature developed in this chamber varies with the process. In the particular case of waste processing, the temperature will be held at 1400° C. or above, preferably in the range of 1500–1600° C. The refractory wall of the mixing chamber 12 is designed to maintain the temperature of the shell below 340° C., and the working lining is selected to withstand the process temperature selected.

The temperature of the plasma generated in the electric arc 17 is at least 5500° C. The waste injection 9 and the tertiary injection 10 complete the material and energy balance of the system to provide the desired temperature in the mixing chamber 12. The energy balance will take into account the energy input provided by the electric arc 17, the chemical reactions experienced in the fixed electrode 4 and in the mixing chamber 12, and the heat and power losses of the system.

The gas along with other products of the reaction will leave the system through the gas output port 15. Any solid particle that may be produced by the chemical reaction, such as carbon particles, will be dropped out at the bottom of the reactor in the solids/liquids collection vessel 14. Solid particle material that may be produced by the chemical reaction, such as carbon particles, will also be dropped out at the bottom of the reactor in the solids/liquids collection vessel 14. The accumulation therein, if any, is removed from time to time.

Figure 5:
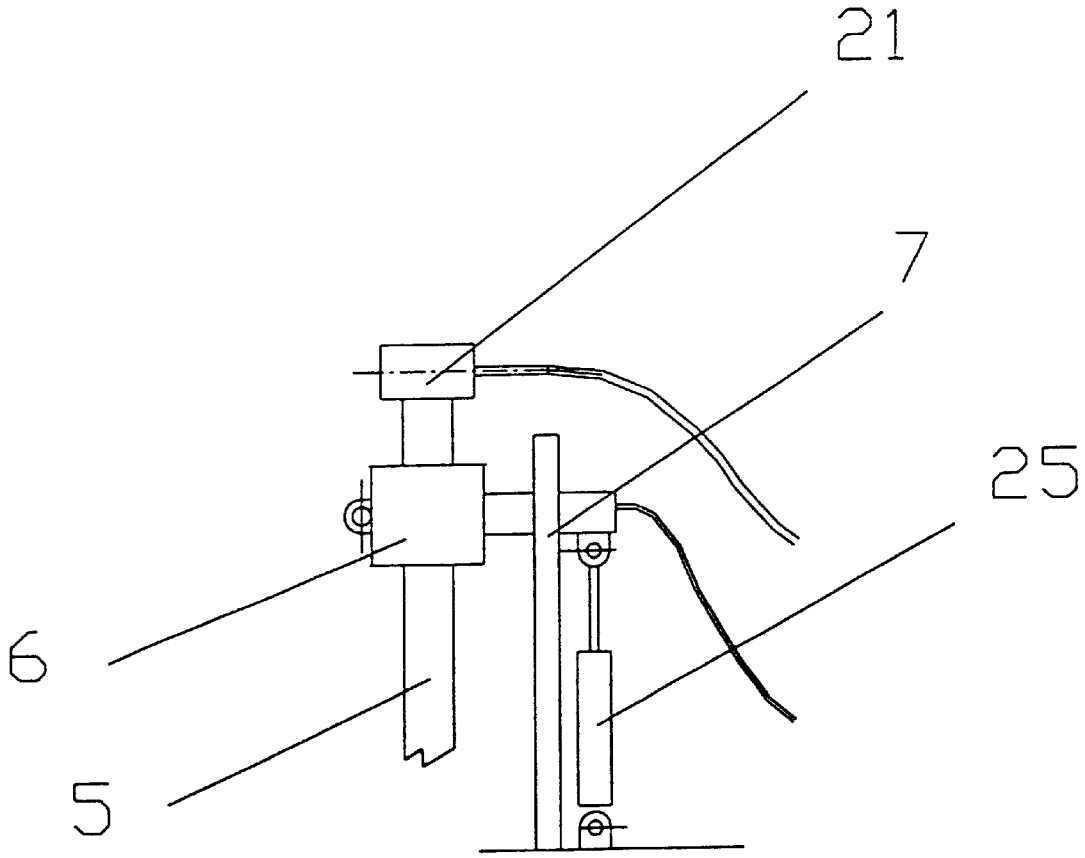
FIG. 5 is a view of the guiding system and positioning system from the side view demonstrating an embodiment of the means for positioning the electrode accommodating the mobile hollow electrode.

FIG. 5 shows the positioning device 7, which has the objective of adjusting the distance between the mobile hollow electrode 5 and the fixed electrode 4 (FIG. 3) to meet the conditions required by the electric system when a particular waste enters. Depending on the operating conditions or the wear of the electrode, the length of the electric arc 17 (FIG. 3) may require a correction. The positioning device 7 moves the mobile hollow electrode 5 vertically to the correct position, in response to these changes. The positioning device 7 consists of a carriage that is attached to the electrode clamp 6, and moves vertically guided by two vertical guides 23. The carriage rolls on the guides supported by four guide rails. The position of the carriage, set by the electrode positioning system 25, is a hydraulic cylinder controlled by the electrical system through a standard hydraulic control system.

In instances where a correction is needed, as sensed by the system controls, the electric system will send the instruction to the hydraulic control system, which will actuate the hydraulic control system, extending or retracting the rod, and repositioning the carriage clamp/mobile electrode subassembly.

The variables accounted for in the adjustment include voltage, power level, and current. The electrode position will be corrected to satisfy the set of electrical conditions, accounting for electrode wear, chemistry of the gas, gas flow rate, and pressure of the reactor. The adjustments made optimize the process variables for the set conditions.

The power supply 19 relied upon in the preferred embodiment system can be any alternating current device. The voltage and power level of these units are fixed, and the current delivered is set by the distance between electrodes. Since there is no reliance on direct current power supplies, the capital cost of the present invention is very low.

The electrodes used in the process consist of standard materials of construction such as graphite, alumina-graphite, composite graphite, tungsten, molybdenum, and, generally, any other refractory or metal. The preferred choice is graphite because of the low cost and high sublimation point.

The electrodes, both fixed and mobile, are consumable in the process. Since the electrodes are not water-cooled, the power efficiency of this system is higher than conventional plasma arc technology, which rely on the use of water-cooling jackets. This cooling wastes about 47% of the energy delivered to the electric arc.

The shell components are carbon steel with internal refractory lining. Internal components are constructed of typical carbon steel.

The instant method described herein is suitable for processing a large number of waste streams aimed to high value metals recovery, production of chemical products, and/or production of synthetic gas. Waste is processed in a whole range of forms, such as powder, liquid, gases, and combinations of the above. As a matter of example, we can mention halide bearing hydrocarbons, catalyst of chemical processes, insecticides, chemical agents, radioactive waste, electric arc furnace dust, contaminated biomass, flyash, and the like. The waste processed will chemically be brought to its elemental constituents, and can be recombined into useful by-products as part of the recycling process.

As an example, the processing of two typical waste streams—electric arc furnace dust, and chlorinated hydrocarbons are described.

Electric Arc Furnace (EAF) Dust Processing

Figure 6:
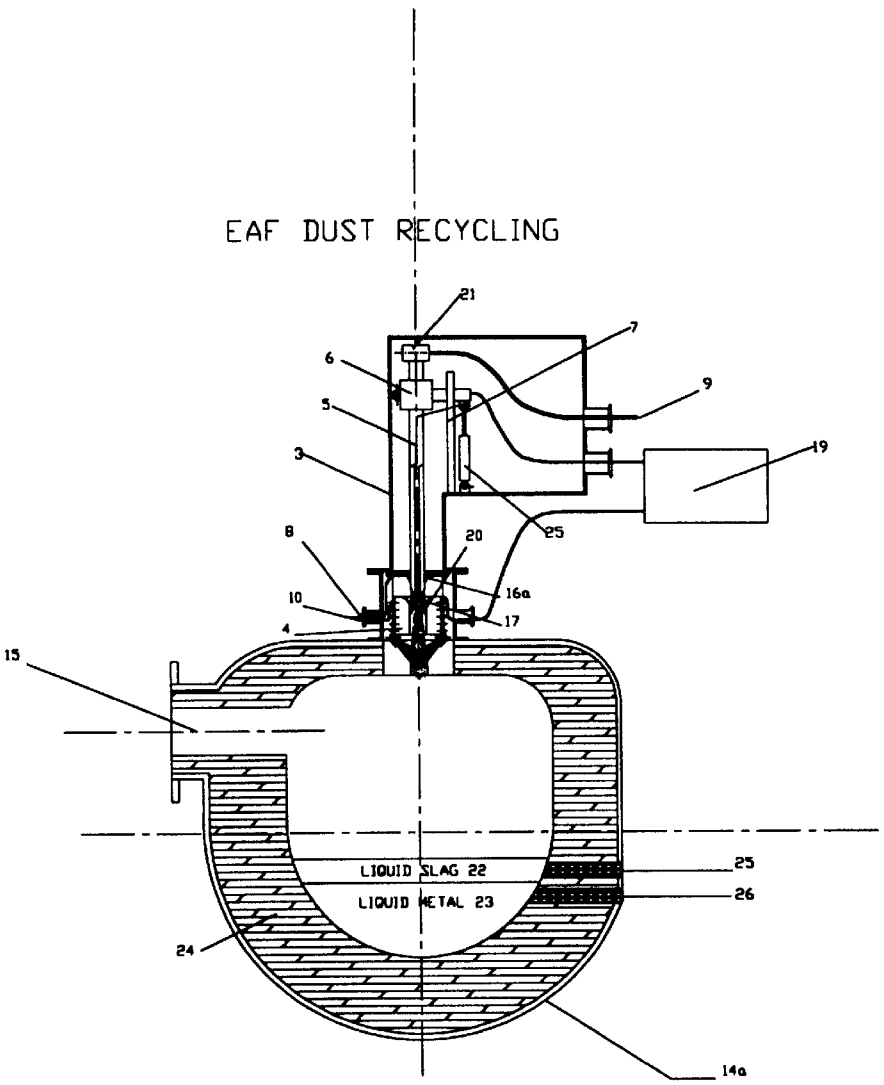
FIG. 6 shows an arrangement of the instant method for recycling EAF dust.
Figure 7:
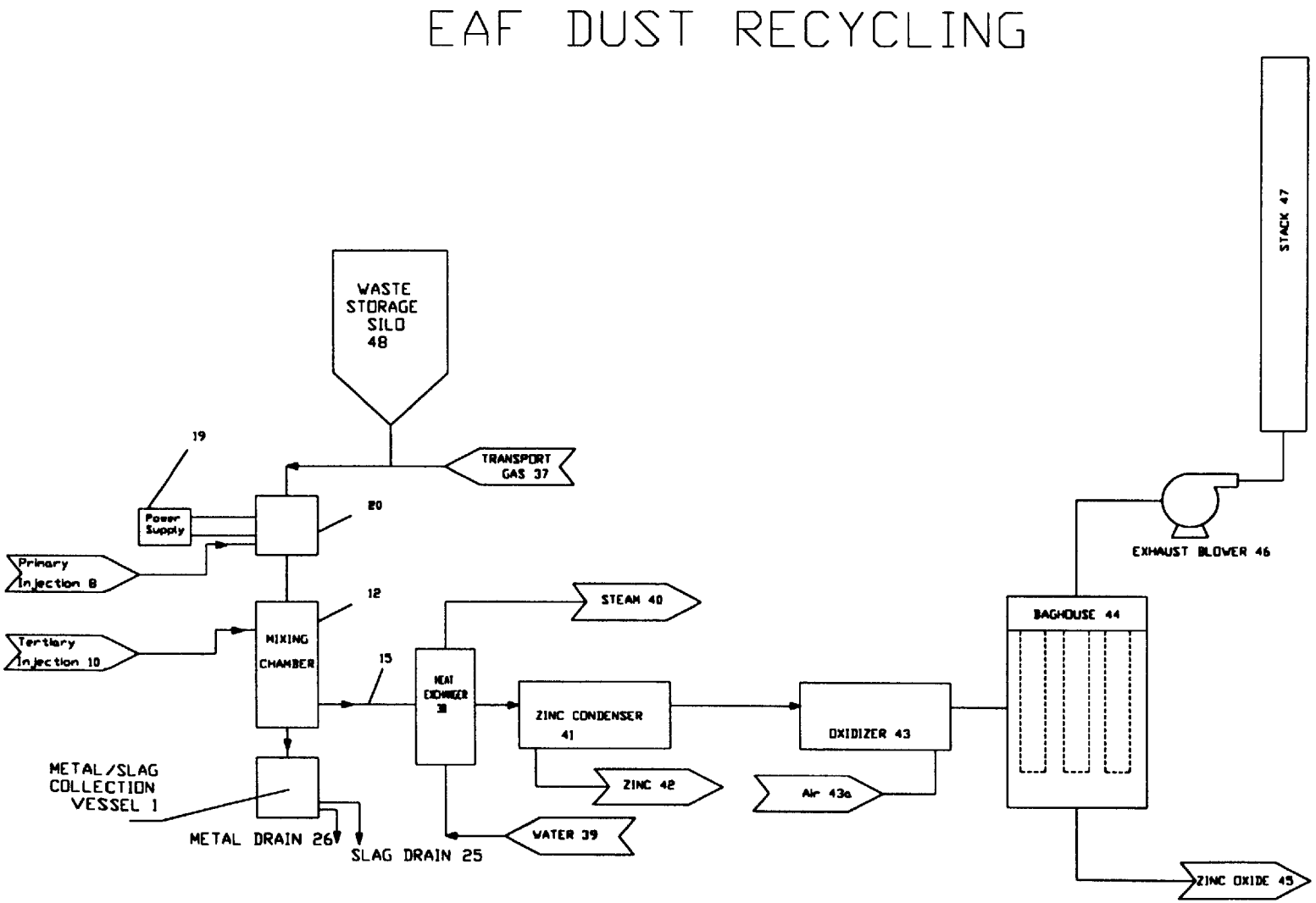
FIG. 7 is process flow diagram showing for the overall method of recycling EAF.

FIGS. 6 and 7 show an arrangement using the instant method to recycle EAF dust. The following (table 1) is a typical analysis of EAF dust:

TABLE 1

| Element | [%] |
|---|---|
| Zn | 19.5 |
| Pb | 2.0 |
| Fe | 24.5 |
| $SiO_2$ | 5.0 |
| CaO | 10.0 |
| F + Cl | 4.3 |
| Cu | 0.2 |
| Cr | 0.35 |
| $Al_2O_3$ | 7.0 |
| MgO | 4.1 |
| Cd | 0.14 |
| Ni | 0.06 |
| Balance | 11.2 |

The electric arc gasifier is attached to the top of a metal/slag collection vessel 14*a* having an inner perimeter lined by a refractory lining 24. The vessel may operate at a slight negative pressure of 2 inches of water column. The pressure of the vessel is controlled automatically by changing the speed of the exhaust blower 46.

The electric arc is formed between the mobile electrode 5 and fixed electrode 4 in the heating chamber 20 as previously described. A primary injection 8, which can be natural gas, a hydrocarbon, or a hydrogen bearing gas, is injected into the heating chamber 20 to produce a hydrogen bearing plasma composed of hydrogen and carbon dust that will flow to the interior of the fixed electrode 4. EAF dust is injected through the center of the mobile hollow electrode 5 into the heating chamber 20. The EAF dust is injected as powder, and a carrier gas, such as natural gas, is used in combination therewith. The EAF dust and carrier gas is mixed with the hydrogen bearing plasma in the interior of the fix electrode 4, thereby forming a mixture of gases, solids, and liquids from a reaction of compounds contained in the EAF dust with hydrogen and carbon developed in the electric arc. The mixture increases in temperature to above 1500° C. At those temperatures zinc and cadmium contained in the EAF dust will vaporize, and will go off with the off-gas through the gas output port 15. Natural gas is used as primary injection 8 gas and as a carrier gas 37 and will crack at the high temperatures developed by the plasma gas producing $H_2(g)$ and $C_{(s)}$, developing a high partial pressure of hydrogen. Hydrogen will react immediately with the halides contained in the EAFD ($Cl^-$ and $Fl^-$) to form the corresponding acids and will prevent the formation of metallic chlorides such as ZnCl and FeCl. Particles of iron or iron oxides will be heated up and melted. The sudden increase in the temperature of the natural gas and the cracking of one mol of natural gas into two mols of hydrogen, will lead to an increase in the velocity of the gas inside of the fixed electrode of approximately 12 times. This high velocity will project the solid and liquid particles of waste toward the liquid bath producing a mechanical separation from the inertial behavior of the gaseous components relative to the condensed (solid/liquid) phase.

The particles will be projected at high velocity to the liquid bath at the bottom of the metal/slag collection vessel 14*a* by the expanding gas developed in the interior of the fix electrode 4, forming a liquid metal bath 23 with high carbon content. Other chemical compounds such as CaO and MgO will be also projected towards the liquid metal bath 23 by the same mechanism, and will form a layer of slag 22.

A tertiary injection 10 of an oxidant such as steam, oxygen or air, and slag formers such as CaO may be injected to control the metallurgical process. The $Al_2O_3$ and MgO contained in the EAF dust will form a slag with the CaO injected. The fluidity of the slag can be improved, if required, with the use of fluxes injected simultaneously with the CaO. Additional oxidants such as oxygen and air or carbon can be added, if required, in the collection vessel 14*a*.

The off gas will contain then CO, $CO_2$, Zn(g), Pb (g), Cd(g), HCl (g), and eventually carbon dust, as well as traces of other compounds, depending on the reduction level desired. FIG. 7 shows the process flow diagram of the application of the instant method for recycling EAF dust. The process will recover iron with an efficiency of at least 98%, and will recover Zn with an efficiency of at least 85%. The following TABLES 2 and 3 show a typical analysis of the by-products obtained in the high temperature reaction zone for an EAF dust of the composition illustrated in TABLE 1.

Gases:

TABLE 2

| Compound | [% vol.] |
|---|---|
| $H_2(g)$ | 29.5 |
| CO(g) | 23.2 |
| $CH_4(g)$ | BDL (1) |
| $H_2O(g)$ | 9.6 |
| Zn(g) | 16.7 |
| HF(g) | 12.2 |
| HCl(g) | 5.6 |
| $CO_2(g)$ | 1.8 |
| $ZnCl_2(g)$ | BDL |
| $FeCl_2(g)$ | BDL |
| PbCl(g) | BDL |
| Pb(g) | 0.4 |

Notes to Table 2:
(1) BDL: Below Detection Level

Solids/Liquids:

TABLE 3

| Compound | [% wt.] |
|---|---|
| ZnO | <0.1 |
| FeO | 56.9 |
| Fe | 0.5 |
| Slag (1) | 42.4 |

Notes to Table 3:
(1) Includes oxides of Mg, Ca, Si, Al and Fe in various forms

To obtain the above reactions, the energy requirement is 670 kWh/ton of Electric Arc Furnace Dust.

The EAF dust can be stored or loaded in a silo 48 mixed with fluxes and eventually coal. The amount of fluxes and carbon will depend on the chemistry of the EAF dust as well as a carrier gas 37 used for the pneumatic conveying of the dust. The system is chemically balanced to maintain a reducing environment and prevent the formation of dioxins or furanes.

The carrier gas 37 selected could be natural gas, or similar gaseous hydrocarbon, which will provide some of the carbon to the system, or it could be nitrogen, or steam, provided that there is not an excess of oxygen in the system to form $CO_2$ that could affect the life of the electrodes.

The primary injection 8 could be natural gas, or similar gaseous hydrocarbon, introduced at a small flow rate just enough to produce a plasma flame inside of the fixed electrode 4 and will provide a high partial pressure of hydrogen in the high temperature reaction zone.

The tertiary injection 10 is preferably steam, oxygen or air, used to oxidize the excess of carbon and reduce the formation of carbon dust in the off gas, or any other suitable oxidant. In the mixing chamber 12 the iron droplets are melted and saturated with carbon, and any iron oxide will be reduced to liquid iron, the extent of the desired iron oxide reduction will depend on the cost of power and the overall economics of the process. In our example we elected to have only partial reduction of iron to less oxygen bearing forms of iron oxide. The reduction of iron is completed in the liquid slag/metal bath by injection of carbon. Any Zn or Cd oxide will be reduced and vaporized to metallic Zn and/or Cd. Inorganic compounds will be fluxed and will form a slag. The excess of carbon will be oxidized to CO exiting through the off-gas duct.

The chemistry of the off-gas will be CO, $CO_2$, carbon dust, $H_2$, and heavy metal vapors, particularly Zn. The temperature of this off-gas is about 1500° C. The excess of energy in the off gas will be recovered by a heat exchanger 38 and converted to steam 40 to preheat the gases injected in the vessel.

Zn vapors contained in the off-gas will be captured be a zinc condenser 41 and removed as metallic zinc 42. The off gases leaving the zinc condenser 41 contain some unrestrained zinc vapor, which will set into an oxidizer 43. A flow of air 43*a* is injected into the oxidizer 43, which will oxidize the zinc to ZnO 45, and will burn the traces of carbon dust carried over, if any. The ZnO 45 is a white powder that separates from the off gas in a high temperature bag house 44. The temperature of the off gas is maintained below 310° C. by the injection of air 43*a* in the proper amount and location. ZnO 45 will be removed from the bottom of the baghouse 44.

The exhaust blower 46 maintains the negative pressure of the system. The by-products obtained from the treatment of the EAF dust are: 1) Liquid Iron with high carbon content. 2) Stabilized slag. 3) Zinc metal. 4) Zinc Oxide. 5) Steam. 6) Liquid Zinc 7) Hydrochloric Acid.

All the above listed products can be sold in the market. No secondary waste is generated by the process.

Chlorinated Hydrocarbons Processing

Since the feed does not have metals or inorganic compounds that may form slag, the configuration of the reactor is similar to the electric arc gasifier. A residence time of at least 8 seconds is allowed in the mixing chamber 12 to complete the reaction of the hydrocarbon.

Figure 8:
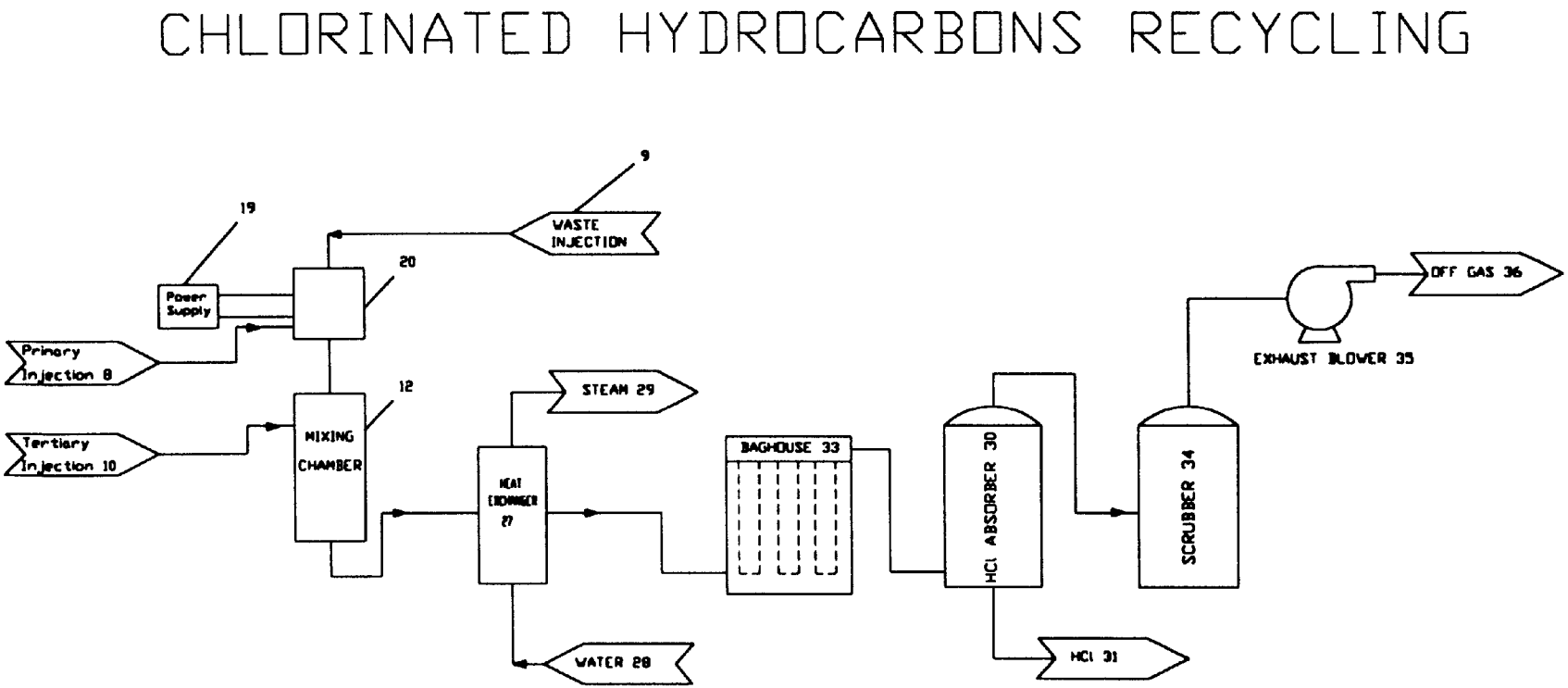
FIG. 8 is a process flow diagram showing an overall method of recycling chlorinated hydrocarbons.

FIG. 8 shows the process flow diagram of this application. Chlorinated hydrocarbons and a carrier gas are injected as liquid or slurries as a waste injection 9. The waste is injected through the center of the hollow electrode and through the fixed electrode of the heating chamber 20. In the fixed electrode the waste will mix with a hydrogen/carbon bearing plasma generated by the primary injection 8, thereby forming chlorinated hydrocarbon waste at a temperature of up to 1600° C. This primary injection 8 can be an inert gas or a mix of inert gas and waste, or any other gas suitable for the purpose of the process such as natural gas, a hydrocarbon, a hydrogen bearing gas, or a mixture thereof. In the mixing chamber 12, an oxidant can be injected as tertiary injection 10. If an oxidant is injected on a stoichiometric ratio, the product of the reaction is CO, HCl, C, and $H_2$. If no oxidant is injected as tertiary injection 10, the product of the reaction will be C, $H_2$, and HCl. The particulars of the economics will dictate the way to operate the electric arc gasifier process in this case.

The off gas, is passed through a heat exchanger 27, which can be a plate or tube heat exchanger. An option will be to use a spray quencher for this function. The quenched off gas is processed through a high temperature baghouse 33 to filter solid particles, which will be mainly carbon dust. The carbon dust produced may be used as fuel or as industrial carbon black, depending on the specific conditions of the process.

The gas, now free of solid matter will be processed through an HCl absorber 30, which will produce a HCl solution of up to 20% of HCl, which can be marketed as such. If it is desired to produce higher HCl concentrations, the whole system has to operate at higher pressure, the off gas will be then processed through a caustic scrubber 34. The negative pressure of the system is provided by an exhaust blower 35. The off gas produced 36 can be used as fuel or as raw material for chemical processes. If the process is run without oxygen (pyrolization), the gas at that point will be industrial grade hydrogen.

The ability of the electric arc gasifier process to destroy the waste in complete absence of oxygen, establish a differences with all other combustion based processes, in which the possibility of forming dioxins, NOx and other undesirable products is intrinsic to the process.

In addition, the carbon dust generated in the process can be marketed as carbon black or other special carbon products, or used to produce energy as well.

I claim:

1. A process for destroying waste using an electric arc gasifier , comprising the steps of:

forming an electric arc in a heating chamber between a mobile electrode and a fixed electrode, injecting a primary fluid into said heating chamber through said electric arc, thereby forming a plasma, wherein said primary fluid is a material selected from the group consisting of gaseous hydrocarbons, argon and nitrogen;

positioning each of said electrodes in response to a system control device, wherein said system control device allows for an adjustment of each of said electrodes based on a flow rate of said primary fluid and a system operating pressure;

mixing a secondary fluid into said plasma forming a mixture of gases, solids, and liquids at a high temperature above 1,400° C., wherein said secondary fluid is a waste and a carrier gas;

passing said mixture of said gases, said solids, and said liquids into said fixed electrode, wherein said mixture of said gases, said solids, and said liquids is accelerated into a mixing chamber by a sudden expansion of said gases;

injecting a tertiary gas into said mixing chamber at pressures up to 150 psi, thereby mixing said mixture of said gases, said solids, and said liquids with said tertiary gas;

providing a collection vessel, wherein said gases of said mixture are separated from said liquids and said solids of said mixture; and, processing said gases.

2. The process of claim 1, wherein after the step of processing said gases, said gases can be used as synthesis gas for commercial use.

3. The process of claim 1, wherein said carrier gas is a material selected from the group consisting of inert gases, hydrocarbons, steam, and CO2.

4. The process of claim 1, wherein said waste is a high value metal bearing spent catalyst from a chemical industry.

5. The process of claim 1, wherein said waste is waste pickle liquor from Tantalum pickling lines.

6. The process of claim 1, wherein said waste is a halide bearing gas, liquid, or solid.

7. The process of claim 1, wherein said waste is a gaseous, liquid, or solid chemical agent.

8. The process of claim 1, wherein said high temperature is preferably in a range of 1,500–1,600° C.

9. The process of claim 1, wherein said tertiary gas is either an oxidant or a reductant.

10. A process for recycling electric arc furnace dust (EAFD) using an electric arc gasifier, comprising the steps of:

forming an electric arc in a heating chamber between a mobile electrode and a fixed electrode;

injecting natural gas, a hydrocarbon, or a hydrogen bearing gas into said heating chamber to form a hydrogen bearing plasma;

injecting said EAFD and a carrier gas into said heating chamber;

mixing said EAFD transported with said carrier gas with said hydrogen bearing plasma within said fixed electrode, thereby forming a mixture of gases, solids, and liquids from a reaction of compounds contained in said EAFD with hydrogen and carbon developed in said electric arc;

producing said mixture of gases, solids, and liquids in an environment with a high partial pressure of said hydrogen, thereby preventing a formation of metallic chlorides;

reacting halides contained in said EAFD with said hydrogen to form corresponding acids;

reacting said halides in an environment deprived of oxygen, thereby preventing a formation of dioxins and furanes;

separating said gases of said mixture from said solids and said liquids of said mixture by means of an inertial behavior of said mixture exiting said fixed electrode;

collecting slag and iron partially or completely reduced in a collection vessel; conveying said gases of said mixture out of said collection vessel; and, processing said gases.

11. The process of claim 10, wherein said carrier gas is natural gas.

12. The process of claim 10, wherein said metallic chlorides include ZnCl and FeCl.

13. The process of claim 10, wherein said halides contained in said EAFD include $Cl^-$ and $F^-$, whereby said corresponding acids formed in the step of reacting said halides with said hydrogen include HCl and HF.

14. The process of claim 10, wherein said gases of said mixture include Zn(g), Pb(g), HCl(g), and CO(g).

15. The process of claim 14, wherein said Zn(g) and said HCl(g) are processed to obtain liquid zinc and hydrochloric acid, respectively.

16. The process of claim 14, wherein said Zn(g) is further processed to obtain zinc oxide.

17. A process for destroying chlorinated hydrocarbon waste using an electric arc gasifier, comprising the steps of:

forming said electric arc in a beating chamber between a fixed electrode and a mobile electrode;

injecting natural gas, a hydrocarbon, a hydrogen bearing gas, or a mixture thereof into said heating chamber, thereby forming a hydrogen/carbon bearing plasma;

injecting chlorinated waste and a carrier gas through a center of said mobile electrode; mixing said chlorinated waste injected through said center with said hydrogen/carbon bearing plasma within said fixed electrode, thereby forming said chlorinated hydrocarbon waste;

heating said chlorinated hydrocarbon waste up to 1600° C.;

cracking said chlorinated hydrocarbon waste to hydrogen, carbon and HCl;

destroying said chlorinated hydrocarbon waste in an environment with no oxygen, thereby preventing the formation of dioxins; and, processing said hydrogen, said carbon, and said HCl.

18. The process of claim 17, wherein for the step of processing said hydrogen, said carbon, and said HCl, said hydrogen can be reused as commercial hydrogen; said carbon can be reused as carbon black; and said HCl can be commercialized as hydrochloric acid.

19. The process of claim 17, wherein after the step of destroying said chlorinated hydrocarbon waste, an oxidant as a tertiary injection may be injected into a mixing chamber to react with said carbon to produce carbon monoxide.

20. The process of claim 19, wherein said carbon monoxide can be further processed and reused as synthesis gas or burned in a flare stack.

* * * * *